US011988114B2

(12) United States Patent
McDeed

(10) Patent No.: US 11,988,114 B2
(45) Date of Patent: May 21, 2024

(54) H2 BOILER FOR STEAM SYSTEM

(71) Applicant: Mitsubishi Power Americas, Inc., Lake Mary, FL (US)

(72) Inventor: David McDeed, Altamonte Springs, FL (US)

(73) Assignee: Mitsubishi Power Americas, Inc., Lake Mary, FL (US)

( * ) Notice: Subject to any disclaimer, the term of this patent is extended or adjusted under 35 U.S.C. 154(b) by 0 days.

(21) Appl. No.: 18/133,355

(22) Filed: Apr. 11, 2023

(65) Prior Publication Data

US 2023/0340896 A1 Oct. 26, 2023

Related U.S. Application Data

(60) Provisional application No. 63/333,320, filed on Apr. 21, 2022.

(51) Int. Cl.
*F01K 25/00* (2006.01)
*F01K 3/20* (2006.01)
(Continued)

(52) U.S. Cl.
CPC ..... *F01K 25/005* (2013.01); *F01K 3/20* (2013.01); *F01K 3/262* (2013.01); *F01K 7/18* (2013.01); *F01K 9/00* (2013.01)

(58) Field of Classification Search
CPC ... F01K 3/20; F01K 3/262; F01K 7/18; F01K 9/00; F01K 25/005; F02C 3/222;
(Continued)

(56) References Cited

U.S. PATENT DOCUMENTS 4,060,990 A 12/1977 Guido et al.
4,148,185 A 4/1979 Somers
(Continued)

FOREIGN PATENT DOCUMENTS

CN 105240061 B 10/2016
CN 105134318 B 3/2017
(Continued)

*Primary Examiner* — Alain Chau
*Assistant Examiner* — Sean V Meiller
(74) *Attorney, Agent, or Firm* — Schwegman Lundberg & Woessner, P.A.

(57) ABSTRACT

A power plant comprises supplies of hydrogen fuel, oxygen fuel and water, a boiler comprising a burner for combusting hydrogen and oxygen to produce heat, combustion products and low/intermediate-pressure steam and a first heat exchanger configured to heat water to generate high-pressure steam, and a steam turbine comprising a first turbine configured to be driven only with the high-pressure steam to provide input to a first electrical generator and a second turbine configured to be driven by low/intermediate-pressure steam from the boiler. A method of operating a steam plant comprises combusting hydrogen fuel in a boiler to produce combustion products and LP/IP steam, turning a turbine with the combustion products, condensing water from the combustion products in a condenser, heating water from the condenser in a heat exchanger within the boiler to produce HP steam and turning a turbine with the steam from the first heat exchanger.

20 Claims, 6 Drawing Sheets

(51) Int. Cl.
*F01K 3/26* (2006.01)
*F01K 7/18* (2006.01)
*F01K 9/00* (2006.01)

(58) Field of Classification Search
CPC .... F02C 3/30; F02C 3/305; F22B 1/02; F22B 283/00
See application file for complete search history.

(56) References Cited

U.S. PATENT DOCUMENTS

| | | | | |
|---|---|---|---|---|
| 5,181,381 | A | 1/1993 | Gounder | |
| 5,255,519 | A | 10/1993 | Kakovitch | |
| 5,347,814 | A | 9/1994 | Kemmer et al. | |
| 5,582,000 | A | 12/1996 | Rannie et al. | |
| 5,755,089 | A | 5/1998 | Vanselow | |
| 5,775,091 | A | 7/1998 | Bannister et al. | |
| 5,950,418 | A | 9/1999 | Lott et al. | |
| 5,953,900 | A | 9/1999 | Bannister et al. | |
| 6,098,398 | A | 8/2000 | Uematsu et al. | |
| 6,263,661 | B1 | 7/2001 | Van et al. | |
| 6,293,104 | B1 | 9/2001 | Kangai et al. | |
| 6,442,924 | B1 | 9/2002 | Talley et al. | |
| 6,655,144 | B2 | 12/2003 | Kangai et al. | |
| 7,178,339 | B2 | 2/2007 | Goldmeer et al. | |
| 7,188,478 | B2 | 3/2007 | Bourgeois | |
| 7,316,105 | B2 | 1/2008 | Haberberger et al. | |
| 7,363,764 | B2 | 4/2008 | Griffin et al. | |
| 8,196,405 | B2 * | 6/2012 | Wolf | F01K 23/00 60/671 |
| 8,281,590 | B2 | 10/2012 | Hinders et al. | |
| 8,341,964 | B2 * | 1/2013 | Finkenrath | F02C 6/16 60/727 |
| 8,671,687 | B2 | 3/2014 | Gudmundson | |
| 8,857,187 | B2 | 10/2014 | Goto et al. | |
| 8,863,521 | B2 | 10/2014 | Goto et al. | |
| 9,664,071 | B2 | 5/2017 | Goto et al. | |
| 10,167,777 | B2 | 1/2019 | Ikeda et al. | |
| 10,597,292 | B2 | 3/2020 | Mokheimer et al. | |
| 11,608,758 | B2 * | 3/2023 | Tanimura | F01K 23/106 |
| 2005/0229603 | A1 * | 10/2005 | Yamada | F22G 1/12 60/39.53 |
| 2006/0266040 | A1 | 11/2006 | Haberberger et al. | |
| 2023/0258123 | A1 * | 8/2023 | Partheepan | F02C 3/34 60/772 |

FOREIGN PATENT DOCUMENTS

| | | | |
|---|---|---|---|
| CN | 105781740 | B | 12/2017 |
| JP | H11325406 | A | 11/1999 |
| JP | 2003106108 | A | 4/2003 |
| JP | 2003148112 | A | 5/2003 |
| JP | 3940481 | B2 | 4/2007 |
| JP | 4418894 | B2 | 12/2009 |
| JP | 2018095512 | A | 6/2018 |
| RU | 2309325 | C1 | 10/2007 |
| RU | 2443871 | C2 * | 2/2012 |
| RU | 2443871 | C2 | 2/2012 |
| RU | 2488903 | C1 | 7/2013 |
| RU | 2709237 | C1 | 12/2019 |
| WO | WO-2018143310 | A1 | 8/2018 |
| WO | WO-2019032755 | A1 | 2/2019 |

* cited by examiner

H2 BOILER FOR STEAM SYSTEM

PRIORITY APPLICATION

This application claims the benefit of priority to U.S. Provisional Application Ser. No. 63/333,320, filed Apr. 21, 2022, the content of which is incorporated herein by reference in its entirety.

TECHNICAL FIELD

The present application pertains generally, but not by way of limitation, to power generation cycles that produce steam for driving steam turbines. More specifically, but not by way of limitation, the present application relates to boilers that combust a fuel to produce steam.

BACKGROUND

Conventional boilers and steam turbines (STs) used for the generation of power are typically fueled by coal, biomass, oil, or natural gas. These boilers have combustors that typically operate just above ambient pressure and produce carbon dioxide as products of combustion, as well as other undesirable emissions. Pressurized water is heated to steam by the combustion products via heat exchangers in the boiler. Following the heat transfer, the combustion products pass through an emissions remediation system, if applicable, and are vented to the environment. In standard boiler configurations, combustion products are separated from the high temperature and pressure steam of a Rankine cycle and vented to atmosphere. From the boiler, the high-temperature and high-pressure steam is fed to a steam turbine to convert the thermal energy to mechanical energy and turn a generator that generates electrical power. Following the steam turbine, steam is condensed and recycled through the heat exchangers in the boiler to continue the cycle.

Overview

The present inventor has recognized, among other things, that problems to be solved in power cycles can include the undesirable release of emissions from combustion products and the inefficient use of the combustion products. For example, conventional boilers that utilize fossil fuels or biomass release carbon dioxide ($CO_2$) that is both undesirable for the atmosphere and unusable in the steam cycle.

Furthermore, the present inventor has recognized that attempts to improve the performance of steam cycles via the use of clean fuels, such as hydrogen ($H_2$) can be difficult. Renewable power generation sources, such as solar, wind and tidal, can be used to generate power in place of carbon-emitting sources. However, renewable power generation sources only produce power when conditions are favorable. Power produced from these sources must be used immediately or the power becomes lost or non-dispatchable. Alternatively, the power can be stored in battery systems that can be expensive and require additional real estate to accommodate. Recent systems have incorporated renewable power generation sources to generate clean fuels that can be stored for use when renewable power generation sources are unavailable. For example, electrolyzers can be powered by renewable power generation sources to produce hydrogen for a steam cycle. Electrolyzers can convert water to hydrogen ($H_2$) and oxygen ($O_2$). Hydrogen so produced via renewable energy is also known as "green hydrogen." The hydrogen can be stored in storage tanks or other facilities for later use. Use of such stored hydrogen within a combustor, instead of fossil fuels, provides time shifting of the renewable power. As the need for energy storage from renewable sources increases, green hydrogen becomes a viable option, particularly for long-term storage and retrieval.

The present inventor has recognized that it can be difficult to acquire the water needed to electrolyzers to sustain electrolysis operations. Not only are large quantities of water used, but the water must also be sufficiently clean for effective electrolysis.

The present subject matter can help provide solutions to these problems and other problems, such as by integrating a steam cycle with an electrolysis process to 1) reduce emissions, 2) time-shift output of renewable power generation sources, 3) obtain useful work from combustion products, and 4) reduce water demand of electrolyzers. Electrolyzers can be used to produce $H_2$ and $O_2$ as inputs to a combustion process in a boiler. The combustion products, including steam, can be used to drive a steam turbine and then can be condensed into water for use in the electrolyzer in a closed-loop system. The combustion products can be absent of, or can have significantly reduced levels of, undesirable emissions. The boiler can be pressurized to facilitate capture of the combustion products and use within the steam cycle to improve steam turbine efficiency. The relatively low energy level energy in the steam can be directly used instead of wasted or transferred into the other steam circuits. Condensed water from the combustion products is captured and utilized in the steam cycle or stored for use with the electrolyzer to make $H_2$ and $O_2$.

In an example, a power plant can comprise a hydrogen fuel supply, an oxygen fuel supply, a water supply, a boiler comprising a burner for combusting hydrogen from the hydrogen fuel supply and oxygen from the oxygen fuel supply to produce heat, combustion products and low/intermediate-pressure steam and a first heat exchanger configured to heat water from the water supply to generate high-pressure steam, and a steam turbine comprising a first turbine configured to be driven only with the high-pressure steam to provide input to a first electrical generator and a second turbine configured to be driven by low/intermediate-pressure steam from the boiler.

In another example, a method of operating a steam plant can comprise combusting hydrogen fuel in a boiler to produce combustion products and low/intermediate-pressure steam, turning a low/intermediate-pressure turbine with the combustion products, condensing water from the combustion products in a condenser, heating water from the condenser in a first heat exchanger within the boiler to produce high-pressure steam, and turning a high-pressure turbine with the high-pressure steam from the first heat exchanger.

This overview is intended to provide an overview of subject matter of the present patent application. It is not intended to provide an exclusive or exhaustive explanation of the invention. The detailed description is included to provide further information about the present patent application.

Figure 1:
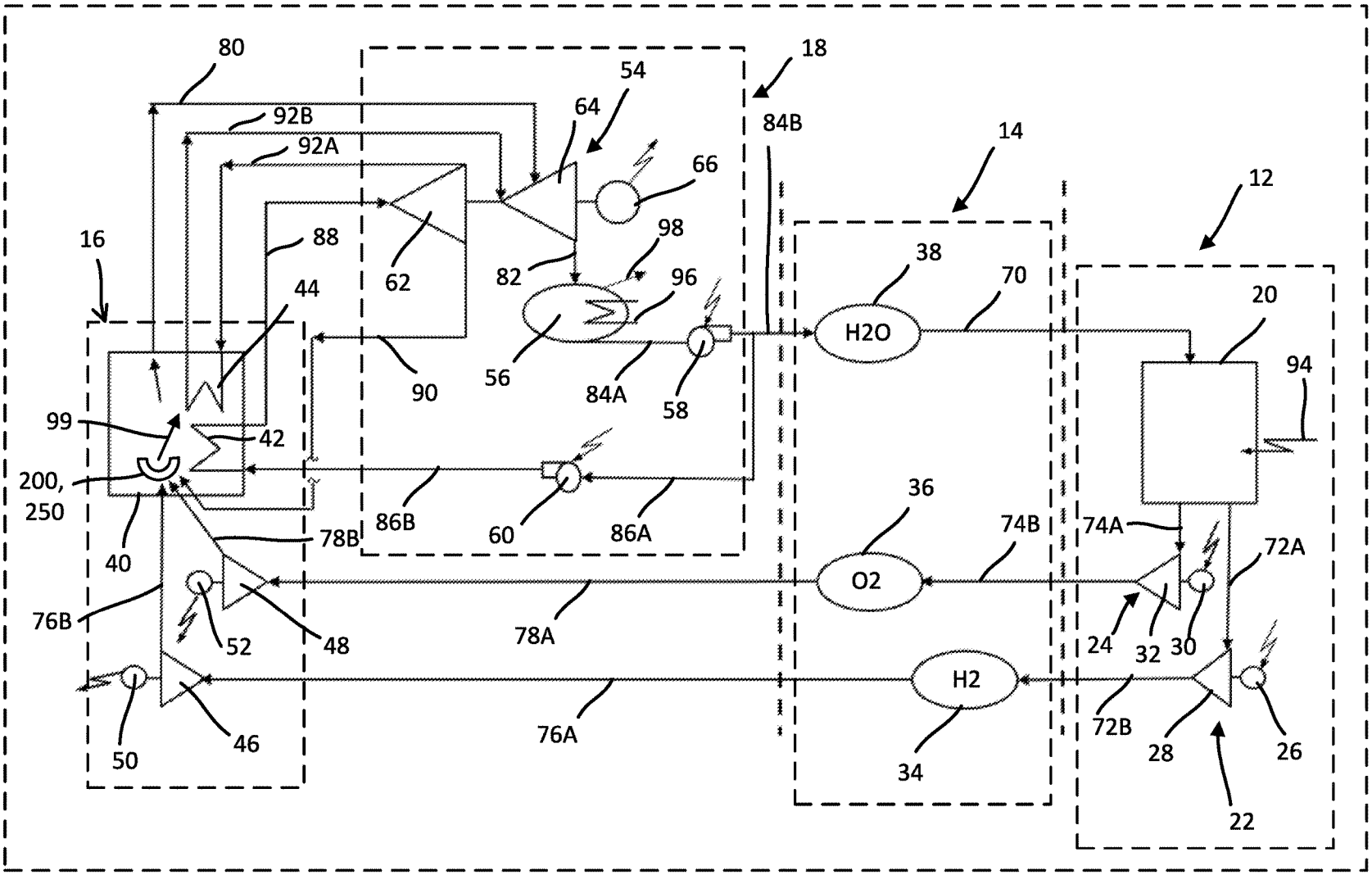
FIG. 1 is a schematic diagram illustrating a steam system comprising an electrolyzer system, a storage system, a steam turbine and a boiler configured to operate near ambient pressure.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

FIG. 1 is a schematic diagram illustrating power system 10A comprising electrolyzer system 12, storage system 14 and boiler 16 integrated with steam system 18.

Electrolyzer system 12 can comprise electrolyzer 20, hydrogen compression device 22, and oxygen compression device 24. Hydrogen compression device 22 can comprise motor 26 and compressor 28. Oxygen compression device 24 can comprise motor 30 and compressor 32.

Storage system 14 can comprise hydrogen storage device 34, oxygen storage device 36 and water storage device 38.

Boiler 16 can comprise boiler structure 40, second heat exchanger 44, first heat exchanger 42, hydrogen expansion device 46 and oxygen expansion device 48. Hydrogen expansion device 46 can be connected to generator 50. Oxygen expansion device 48 can be connected to generator 52.

Steam system 18 can comprise steam turbine 54, condenser 56, first pump 58 and second pump 60. Steam turbine 54 can comprise first turbine 62, second turbine 64 and generator 66. First turbine 62 and second turbine 64 can be connected via a shaft, which can additionally be coupled to generator 66.

Electrolyzer 20 can be configured to receive water from water storage device 38 through line 70. Electrolyzer 20 can output hydrogen, e.g., H2, at line 72A to hydrogen compression device 22, which can provide hydrogen to hydrogen storage device 34 at line 72B. Electrolyzer 20 can output oxygen, e.g., O2, at line 74A to oxygen compression device 24, which can provide oxygen to oxygen storage device 36 at line 74B.

Hydrogen expansion device 46 can draw hydrogen from hydrogen storage device 34 at line 76A and allow hydrogen to flow to boiler 16 through line 76B. Steam can be mixed with the hydrogen upstream of the boiler and/or within boiler 16 as indicated by arrow 99. Oxygen expansion device 48 can draw oxygen from oxygen storage device 36 at line 78A and allow oxygen to flow to boiler 16 at line 78B. Steam can be mixed with the oxygen upstream of the boiler and/or within boiler 16 as indicated by arrow 99. As discussed in greater detail below with reference to FIGS. 4 and 5, hydrogen, oxygen and steam can be introduced into boiler 16 using burners 200 or 250, and nozzles 204A and 204B or nozzles 254A and 254B.

Boiler 16 can provide combustion products to second turbine 64 of steam system 18 at line 80. Second turbine 64 can provide steam to condenser 56 at line 82. First pump 58 can obtain water from condenser 56 at line 84A and provide water to water storage device 38 at line 84B. First pump 58 can additionally provide water to second pump 60 at line 86A and pump 60 can provide water to first heat exchanger 42 at line 86B. First heat exchanger 42 can provide steam to first turbine 62 of steam system 18 at line 88. First turbine 62 can provide steam to boiler 16 at line 90. First turbine 62 can additionally provide steam to second heat exchanger 44 at line 92A and second heat exchanger 44 can provide steam to second turbine 64 at line 92B.

Electrolyzer 20 can comprise one of a plurality of electrolyzers configured to convert electrical input and water into hydrogen (H2) and oxygen (O2). Electrolyzer 20 can receive electrical input 94, which can be provided by renewable power generation sources, such as hydroelectric facilities, solar panels, wind turbines and the like. However, electrolyzer 20 can be operated with electrical input from any source in other examples, such as when renewable energy is not available. However, the present disclosure contemplates electrolyzer 20 can be operated when renewable energy is available to provide H2 and O2 to storage devices 34 and 36, respectively, for operation of boiler 16 when renewable energy is unavailable.

In examples, hydrogen compression device 22 and oxygen compression device 24 can be used to provide pressurized H2 and O2 to storage devices 34 and 36, respectively, via lines 72A-74B. For example, some types of electrolyzers produce H2 and O2 at relatively low pressures, such as 20 to 30 bar. In examples, storage devices 34 and 36 can comprise tanks or other storage vessels. In examples, storage devices 34 and 36 can comprise salt caverns. Motors 26 and 30 can be provided with electrical input from the grid or from renewable power generation sources to operate compressors 28 and 32, respectively. Compressors 28 and 32 can comprise reciprocating compressors, rotary compressors, centrifugal compressors and the like.

Expansion devices 46 and 48 can comprise devices through which high-pressure H2 and O2 can be passed, via lines 76A and 78A, to expand the gasses to pressures suitable for use in boiler 16 via lines 76B and 78B. Expansion devices 46 and 48 can additionally produce work that can be used to drive electrical generators 50 and 52, respectively. In examples, expansion devices 46 and 48 can comprise axial flow turbines or radial expanders. Electricity output of electrical generators 50 and 52 can be output to the grid or used as inputs for other portions of system 10A.

H2 and O2 from expansion devices 46 and 48 can be provided to boiler 16 at burner injectors, such as those described with reference to FIGS. 3 and 4. The H2 and O2 can be mixed and ignited to produce H2O. The combustion process will also release heat, or exothermic energy, that can be used to heat H2O, e.g., water or steam, in heat exchangers 42 and 44, as will be discussed in greater detail below. Furthermore, steam from first turbine 62 can be provided to boiler 16 to provide structural cooling to boiler 16 and to help control the combustion process, as will be discussed in greater detail below. In the example of FIG. 1, combustion within boiler 16 can occur at a relatively low pressure near ambient pressure, such as at approximately 10 pounds per square inch (PSI) [~0.7 BAR] to approximately 50 PSI (~3.4 BAR). In other examples, such as the example of FIG. 2, combustion within boiler 16 can occur a relatively high pressure above ambient pressure, such as at approximately 400 PSI (~27.6 BAR), which can be the pressure in line 92B.

In any case, temperatures within boiler 16 can reach over approximately 1300° F. (~704° C.).

Steam turbine 54 comprise include a dual-spool system configured to convert pressurized gases to rotational shaft power for driving electrical generator 66. First turbine 62 can comprise a high-pressure spool and second turbine 64 can comprise a low/intermediate pressure spool. Steam from boiler 16 can be provided to steam system 18 at low/intermediate pressure through line 80. Steam in line 80 can reach or exceed temperatures of approximately 300° F. (~150° C.). Steam in line 80 can comprise a combination of combustion products and steam at low/intermediate pressure. Low-pressure steam can enter second turbine 64, thereby contributing to rotational shaft output that can be used to drive electrical generator 66. Electrical output of generator 66 can be provided to the grid or other portions of system 10A. Steam expanded by turbine 64 can be collected in condenser 56 via line 82. Condenser 56 can include heat exchanger 96 that can act as a heat sink to remove heat from the condensate. The collected heat can be used elsewhere in system 10A or removed from system 10A. Condenser 56 can also include deaerator 98 to allow non-condensable material to be removed from system 10A. In examples, non-condensable material can be rejected to the atmosphere.

Pump 58 can be used to move water from condenser 56 to storage device 38, which can comprise any suitable tank or vessel. Pump 58 can be operated with electrical input from the grid or system 10A. As discussed, water from storage device 38 can be provided to electrolyzer 20 to produce H2 and O2. Lines 70, 72A, 72B, 74A, 74B, 76A, 76B, 78A, 78B, 80, 82, 84A and 84B can form a closed-loop system where hydrogen and oxygen can be recycled through electrolyzer 20, boiler 16 and steam system 18 in various forms, such as H2, O2 and H2O, as needed to propagate operation of system 10A. As such, system 10A can be configured to reuse water from the combustion process within boiler 16 to produce additional combustion inputs with electrolyzer 20. Thus, water demand from electrolyzer 20 to operate system 10A can be reduced compared to systems that need a continuous supply of new water to produce H2 and O2, such as conventional systems that burn fossil fuels that produce unusable combustion byproducts including CO2 and nitrogen.

Water from condenser 56 can additionally be provided to heat exchanger 44 using pump 60, via lines 86A and 86B. Pump 60 can be operated with electrical input from the grid or system 10A. Water within heat exchanger 44 can be heated and boiled into steam. In examples, the steam can be heated to pressures up to and above approximately 2,000 PSI (~138 BAR). Steam generated by heat exchanger 44 can be provided to first turbine 62 via line 88. First turbine 62 can expand the steam to extract work for operating generator 66. A slip stream of the expanded steam can be routed to boiler 16 via line 90 and used for cooling burners, such as burners 200 and 250 of FIGS. 3 and 4 and for use as a diluent to temper the combustion process within boiler 16. The majority of the steam from first turbine 62 can additionally be provided to heat exchanger 44 via line 92A. Steam in line 92A can comprise intermediate pressure, cold re-heat steam, and can reach pressures of approximately 400 PSI (~27.6 BAR). Heat exchanger 44 can heat the steam that has been lowered in pressure by turbine 62 to further drive turbine 64 via line 92B. Steam in line 92B can comprise intermediate pressure, hot re-heat steam. Each of heat exchangers 42 and 44 is encased in the boiler. For example, boiler structure 40 of boiler 16 can comprise a shell and heat exchangers 42 and 44 can comprise tubes extending through boiler structure 40 in a serpentine fashion. Heat exchangers 42 and 44 can comprise any suitable heat exchanger known in the art.

System 10A can provide an integrated system that efficiently converts water from storage device 38 to rotational shaft power that can produce electrical power at generator 66. Electrolyzer 20 can convert the water to combustion fuel, e.g., H2 and O2, and boiler 16 can combust the H2 and O2 to release thermal energy to provide productive work and can convert the H2 and O2 back into water, e.g., H2O. Because H2 and O2 are used as combustion products, emissions from boiler 16 are additionally curtailed compared to burning of fossil fuels. Furthermore, integration of intermediate-pressure steam can enhance heat transfer from boiler 16 to steam system 18 without significantly increasing cost.

Figure 2:
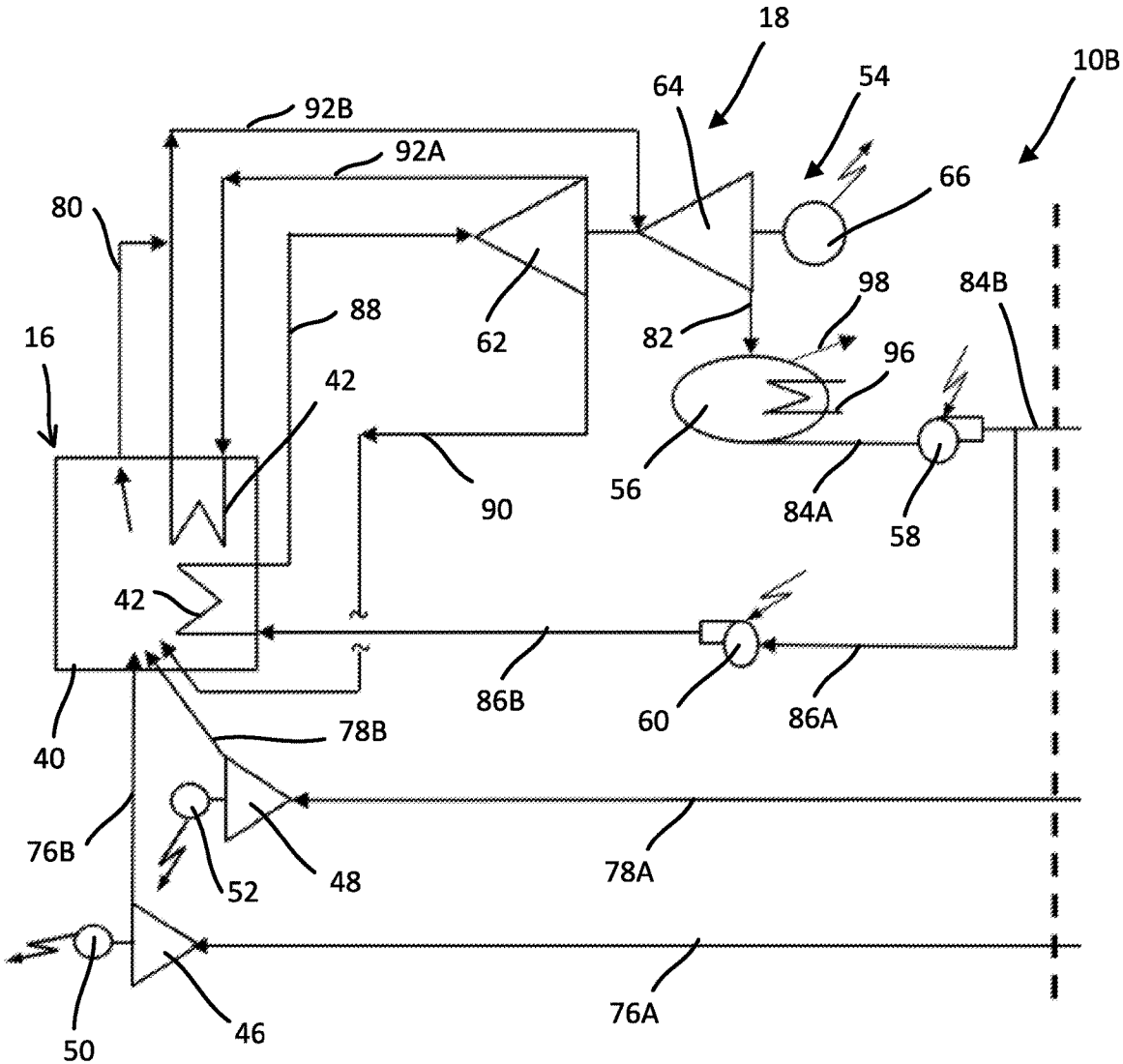
FIG. 2 is a schematic diagram illustrating a steam power system comprising a steam turbine and a boiler configured to operate with three pressure levels: high pressure, intermediate pressure, and low pressure.

FIG. 2 is a schematic diagram illustrating power system 10B comprising boiler 16 integrated with steam system 18 at intermediate pressure. Power system 10B can comprise the same elements as power system 10A of FIG. 1, except line 80 can feed into line 92B rather than directly flowing into turbine 64. Routing of intermediate-pressure steam into line 92B can additionally require the pressure within boiler 16 to be increased. For example, the pressure of steam in line 80 would need to be higher, as compared to FIG. 1, in order to properly merge with steam in line 92B. Pressure in boiler 16 can be increased by combusting additional fuel. Feeding of intermediate-pressure steam from line 80 into intermediate-pressure steam in line 92B can further increase the efficiency of steam system 18 over the configuration of FIG. 1 by further increasing the heat transfer from boiler 16 to steam system 18. As shown in FIG. 2, for example, boiler 16 can remain a single drum boiler and steam turbine 54 can have only two steam inlets. Both of these features can reduce the complexity of system 10B.

Figure 3:
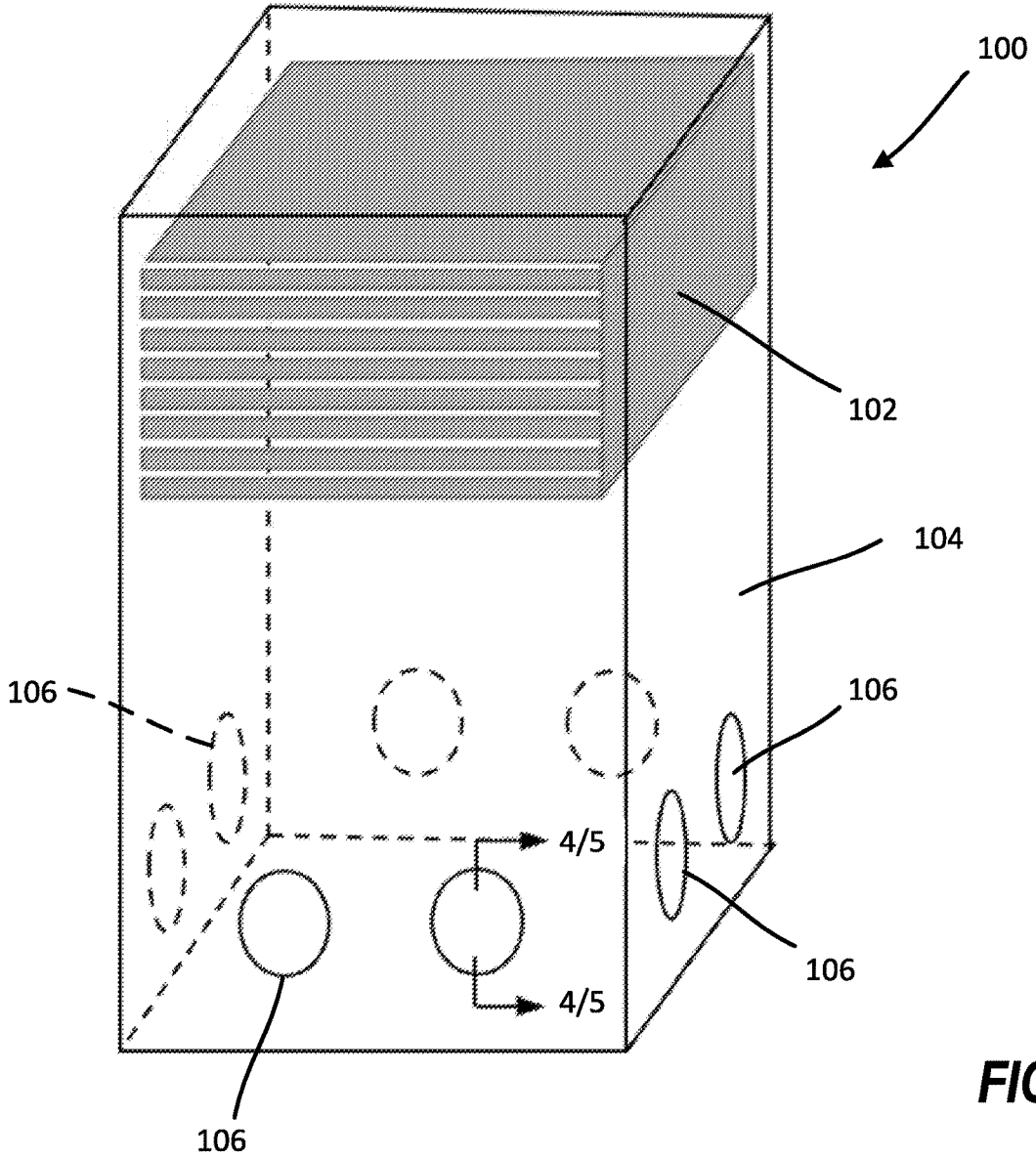
FIG. 3 is a schematic illustration of a boiler for use with the steam systems of FIGS. 1 and 2 having heat exchangers positioned within a boiler shell configured to receive burners.

FIG. 3 is a partial schematic illustration of boiler 100 suitable for use with power system 10A of FIG. 1. Boiler 100 can comprise heat exchangers 102 positioned within boiler shell 104. Boiler shell 104 can comprise sockets 106 for receiving burners, such as burners 200 and 250 of FIGS. 4 and 5. Boiler 100 can comprise an example of boiler 16 of FIG. 3. Boiler 100 can be configured to operate at atmospheric pressure, e.g., approximately 14.7 PSI (~1 BAR), and up to pressures of approximately 2,000 PSI (~138 BAR).

Shell 104 can comprise a structural component configured to support heat exchangers 102 and burners 200 or 250. Shell 104 can comprise an enclosure or partial enclosure suitable for carrying out a combustion process under pressure and thus can comprise a vessel capable of withstanding high pressures and high temperatures. Shell 104 can be fabricated from stainless steel, cast iron or other materials. In examples, shell 104 can comprise a rectangular body having four sides that each receive two sockets 106. Sockets 106 can comprise cut-outs or openings in shell 104 configured to provide access to the inside of shell 104 for burners 200 and 250 of FIGS. 3 and 4. Shell 104 can comprise a plurality of sockets 106 to allow for fuel to be distributed, e.g., uniformly, across the cross-section of shell 104. Sockets 106 can be placed near the bottom of shell 104 with heat exchangers 102 positioned near the top of shell 104. Heat exchangers 102 can comprise heat exchanger 42 and heat exchanger 44 of FIG. 1, which can be placed in shell 104 to receive combustion products in series or in parallel. The top of shell 104 can comprise an exit for combustion products, which can be collected in various pipes or the like (not illustrated). Thus, as the fuel inputs, such as H2 and O2, are burned within shell 104, heat can flow across heat exchangers 102, which can transfer the heat to fluid, e.g., H2O, within heat exchangers 102.

Figure 4:
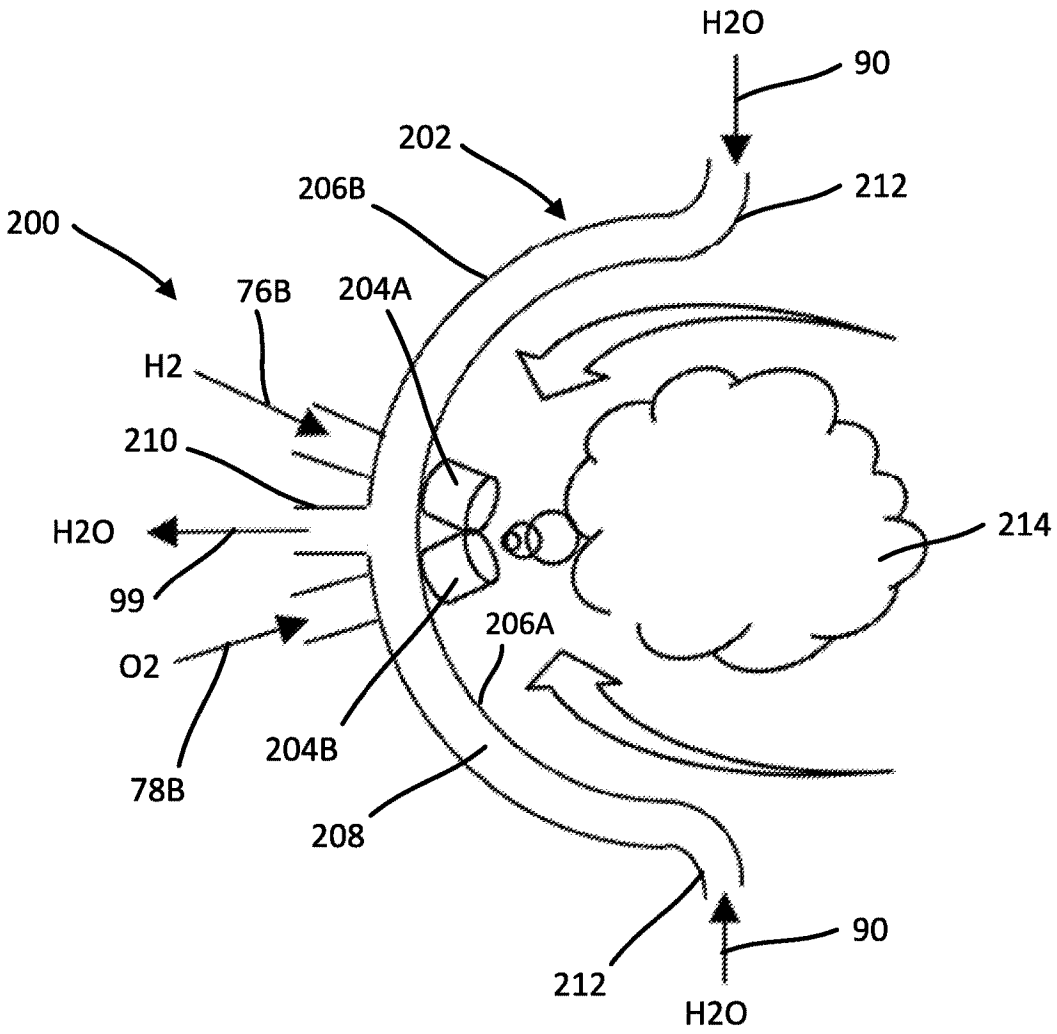
FIG. 4 is a schematic illustration of a first type of cooled burner configured to be mounted to the boiler shell of FIG. 3.

FIG. 4 is a schematic illustration of a burner 200 configured to be mounted to boiler shell 104 of FIG. 3 at one of sockets 106. Burner 200 can comprise body 202, first injector 204A and second injector 204B. Body 202 can comprise inner wall 206A, outer wall 206B, internal passage 208, outlet 210 and flange 212.

Burner 200 can be mounted to shell 104 of boiler 100 (FIG. 3). For example, body 202 can comprise a bulbous structure surrounded, completely or partially, by flange 212. Body 202 can be inserted into socket 106 (FIG. 3) so that flange 212 contacts shell 104. Flange 212 can be attached to shell 104 via any suitable means, such as welding or riveting.

Fuel can be provided to burner 200 via injectors 204A and 204B. For example, injector 204A can be connected to line 76B (FIG. 1) to receive H2 and injector 204B can be connected to line 78B (FIG. 1) to receive O2. An ignitor (not illustrated) can be located within body 202 to initiate combustion of H2 and O2 and produce flame ball 214. As mentioned, temperatures within boiler 16 can reach temperatures over approximately 1300° F. (~704° C.). As such, burner 200 can be provided with cooling to prevent damage to body 202. In the example of FIG. 4, body 202 can comprise a closed-loop cooling circuit formed by internal passage 208 and outlet 210. A cooling medium can be introduced into internal passage 208 via openings in body 202. In the illustrated example, openings can be provided at the radial ends of flanges 212. When introduced at specific location or in a sheet film around the edge, the cooling medium flows between inner wall 206A and outer wall 206B to remove heat from body 202. After collecting heat, the cooling medium can exit body 202 at outlet 210. Outlet 210 can comprise an opening in outer wall 206B that can be connected to a pipe or conduit. In examples, the cooling medium can comprise steam or water from steam system 18 (FIG. 1). For example, water from condenser 56 or steam from a portion of steam system 18 at a temperature lower than that of the combustion process can be introduced into flange 212 and outlet 210 can connect to another portion of steam system 18 or storage device 38.

Figure 5:
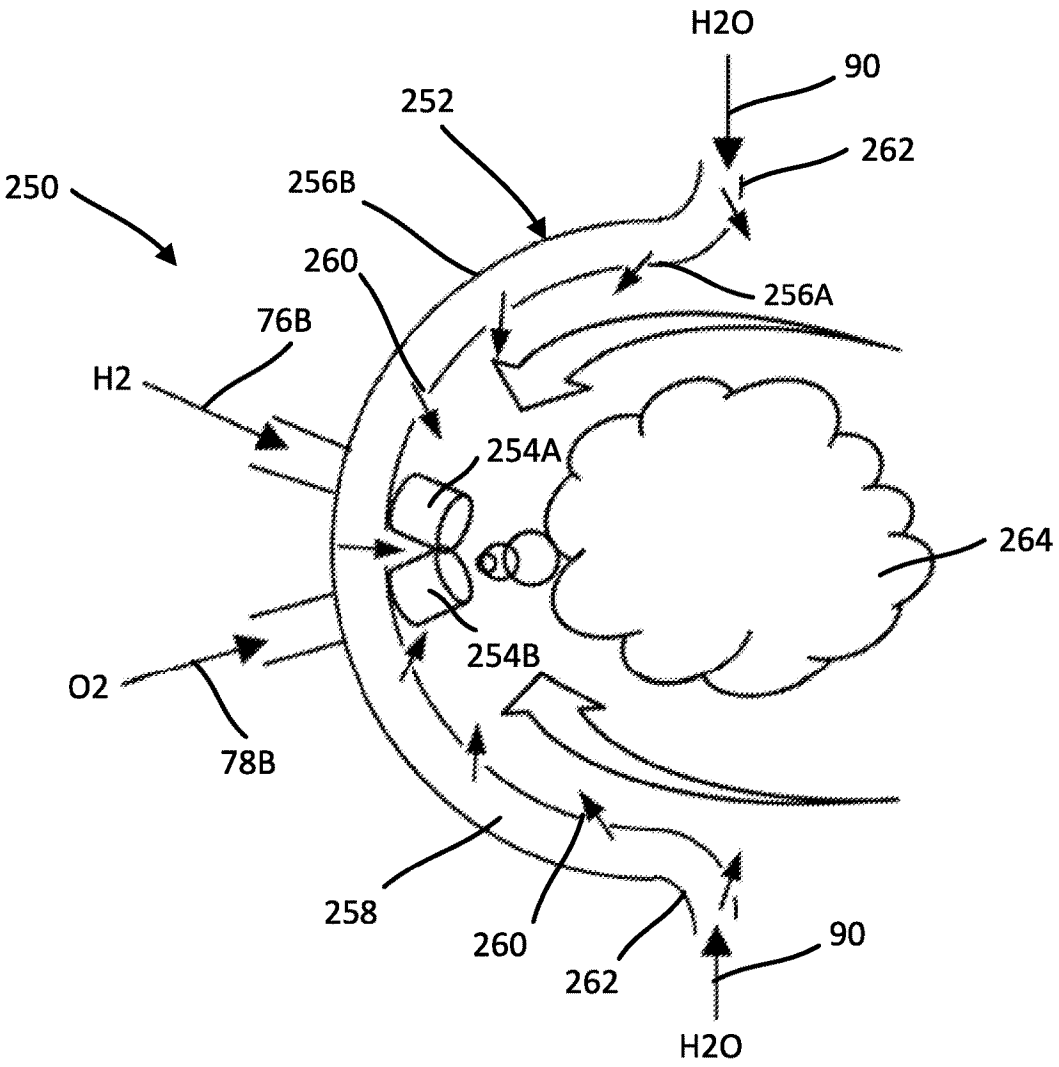
FIG. 5 is a schematic illustration of a second type of cooled burner configured to be mounted to the boiler shell of FIG. 3.

FIG. 5 is a schematic illustration of burner 250 configured to be mounted to boiler shell 104 of FIG. 3 at one of sockets 106. Burner 250 can comprise body 252, first injector 254A and second injector 254B. Body 252 can comprise inner wall 256A, outer wall 256B, internal passage 258, orifices 260 and flange 262. Burner 250 can be configured similarly as burner 200 of FIG. 5 except for outlet 210 being replaced by a matrix of orifices 260. Thus, the cooling circuit of burner 250 can comprise an open loop cooling circuit. Orifices 260 can comprise small openings in inner wall 206A to eject or emit a cooling medium from internal passage 258 into the combustion zone on the interior of body 252. As with burner 200, the cooling medium can comprise steam from system 10A. The steam can cool burner 250 by engagement with inner wall 256A. The steam can also mix with H2 and O2 within body 252 to influence the combustion process at flame ball 264. For example, the steam from orifices 260 can act as a diluent that reduces the combustion process temperature.

In examples, boiler 100 of FIG. 3 can be provided with combinations of burners 200 and burners 250 to provide closed-loop and open-loop cooling.

Figure 6:
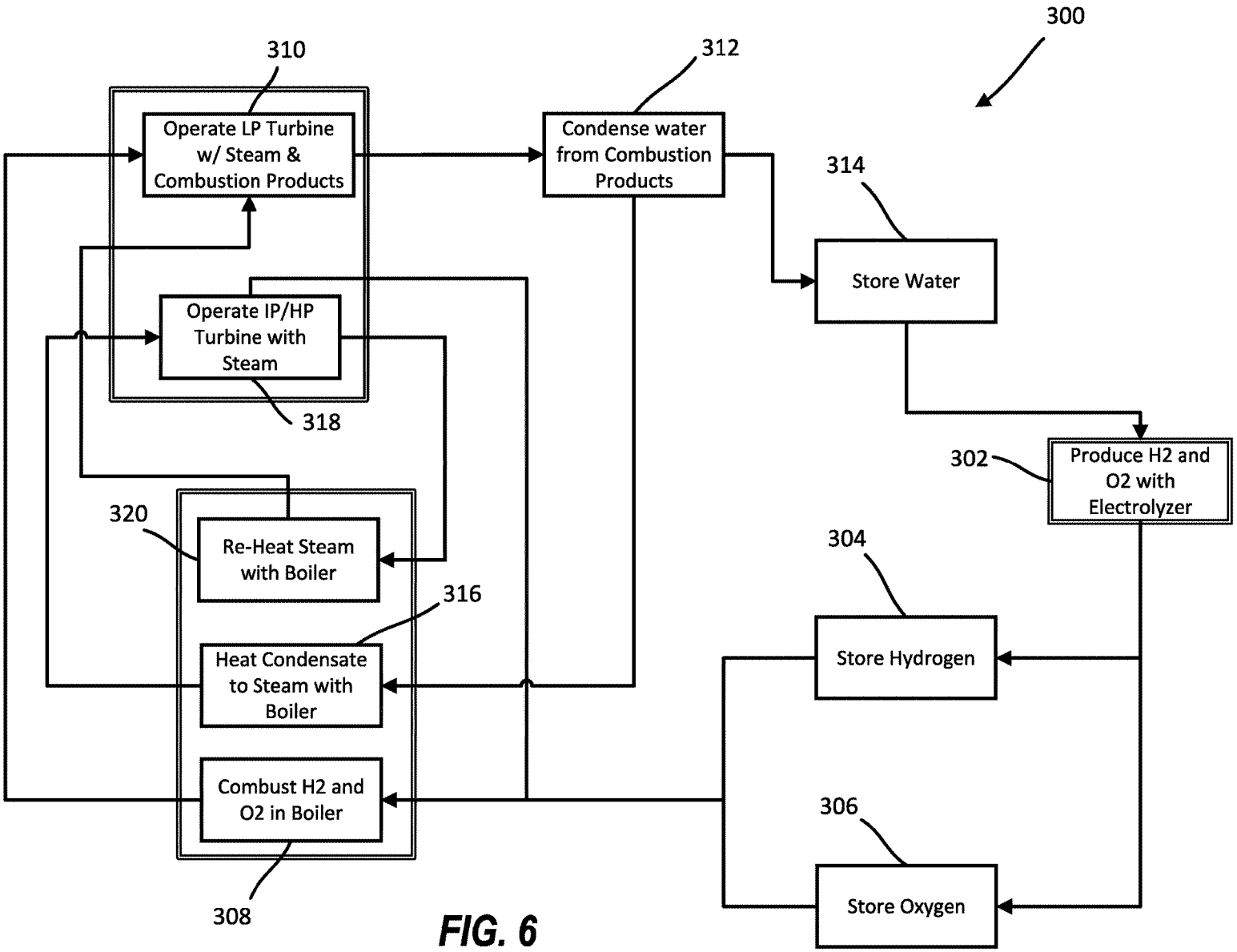
FIG. 6 is a block diagram illustrating steps of methods used to integrate electrolysis operation with a hydrogen and oxygen fired boiler of a steam system.

FIG. 6 is a line diagram illustrating steps of method 300 for operating power systems 10A and 10B of FIGS. 1 and 2. Method 300 can additionally be representative of the operation of other power plants configured similarly to or different than those of FIGS. 1-5. Method 300 can comprise contemporaneous operation of steam system 18, boiler 16 and electrolyzer 20, though not necessarily simultaneously. For example, electrolyzer 20 can be operated to generate and store H2 and O2 while boiler 16 and steam system 18 are not operating, and boiler 16 and steam system 18 can be operated while electrolyzer 20 is not operating.

At step 302, electrolyzer 20 can be operated. A single electrolyzer is illustrated in FIG. 1, but more than one of electrolyzer 20 can be used. Electricity can be used to convert water provided to electrolyzer 20 to O2 gas and H2 gas. In examples, the O2 gas and H2 gas can be at elevated pressures, such as at 50 bar or above. In additional examples, O2 gas and H2 gas can be provided by other means than an electrolysis unit, such as from pressurized storage tanks. Electricity can be provided to electrolyzer 20 via renewable power generation sources, such as wind, solar and hydro. Electricity can additionally be provided by a connection to a power grid. Water can be provided to electrolyzer 20, such as from storage device 38 or an external source including a makeup water source for steam system 18 or a body of water, such as a lake or pond. As mentioned, step 302 can be executed while conditions are favorable for renewable power generation sources, such as wind, solar and hydro.

At step 304, hydrogen generated at step 302 can be stored, such as in storage device 34. The hydrogen can be pressurized using a pump for transport to a storage tank, vessel or cavern. In additional examples, electrolyzer 20 can generate pressurized H2.

At step 306, oxygen generated at step 302 can be stored, such as in storage device 36. The oxygen can be pressurized using a pump for transport to a storage tank, vessel or cavern. In additional examples, electrolyzer 20 can generate pressurized O2.

Release of hydrogen and oxygen from storage devices of steps 304 and 306 can be coordinated with operation of boiler 16 via a controller for systems 10A and 10B. For example, appropriate valving can be automatically opened based on demand from boiler 16 via the controller. Release of hydrogen and oxygen can be executed when conditions are un-favorable for renewable power generation sources, such as wind, solar and hydro.

At step 308, hydrogen and oxygen can be combusted to produce exhaust products and water in the form of steam. For example, H2 and O2 from electrolyzer 20, which has been stored in storage devices 34 and 36, respectively, can be provided to boiler 16 for combustion. The combustion process can produce combustion products that can be directly used to rotate a turbine and can release heat that can be used to generate steam to further rotate the turbine.

At step 310, steam and combustion products from step 308 can be provided to a steam turbine to produce rotational shaft power. For example, steam and the combustion products can be provided to second turbine 64 at low pressure to produce electricity with generator 66. As such, all of the products of combustion of boiler 16 can be used to produce mechanical power. In examples, electrical power generated at step 310 can be provided to the grid. Step 310 is conducted simultaneously with step 316 discussed below in order to produce adequate power to rotate the steam turbine.

At step 312, steam from step 310 can be condensed into water. For example, the steam can be separated from non-condensable matter of the combustion products and then condensed into water. Heat from the condensed water can be extracted by a heat sink to cool the water to appropriate temperatures for storage and electrolysis. The heat can be used elsewhere in method 300. Additionally, non-condensable products of combustion or ingress to the system can be separated from the steam and water. For example, inducted gases such as nitrogen can be pulled from the condenser for appropriate disposal.

At step 314, water condensed at step 312 can be stored for later use. For example, condensed water from steam system 18 can be stored in storage device 38. In additional examples, makeup water from another source can be added to storage device 38 to replace water consumed by any of electrolyzer 20, boiler 16 and steam system 18.

Release of water from storage device 38 of step 314 can be coordinated with operation of electrolyzer 20 via a controller for systems 10A and 10B. For example, appropriate valving can be automatically opened based on demand from electrolyzer 20 via the controller.

At step 316, water from step 312 can be heated to produce steam for operating a steam turbine. For example, water from condenser 56 can be provided to heat exchanger 42 within boiler 16 to produce high-pressure steam.

At step 318, steam from step 316 can be provided to a steam turbine to produce rotational shaft power. For example, the high-pressure steam can be provided to first turbine 62 to produce electricity with generator 66.

At step 320, steam expanded at step 318 can be re-heated for use in the turbine of step 310. For example, steam from first turbine 62 can be routed through heat exchanger 44 in boiler 16 for use in second turbine 64.

Additionally, steam expanded at step 318 can be provided to the boiler at step 308 to cool various boiler components and to manage the combustion process.

The systems and methods of the present disclosure can achieve numerous benefits over conventional boiler systems and electrolyzer systems. For example, storage system 14 can store components for operation of electrolyzer 20 and boiler 16 to allow for operation of systems 10A and 10B when renewable energy is not available. Combustion of H2 and O2 within boiler 16 can significantly reduce emissions, to a point oft being practically eliminated as compared to the combustion of fossil fuels or biomass, because the byproducts of combustion of H2 and O2 are water and heat. Thus, emissions of NOx and CO2 can be practically eliminated. Boiler 16 can experience significantly less thermal losses than conventional boilers by the incorporation of the combustion products (e.g., exhaust) into the Rankine cycle. In other words, energy that would otherwise be discarded, such as by ultimately being released to the atmosphere, can be harvested in the Rankine steam cycle. Furthermore, combustion within boiler 16 at middle or intermediate pressure can enhance heat transfer over atmospheric pressure, therefore requiring boiler 16 to have less surface area to affect the heat transfer, without increasing costs as significant as costs associated with high-pressure combustion equipment. Thus, boiler 16 can be smaller and less expensive than conventional boilers due to the aforementioned heat transfer capability at thigh pressure. The combustion of H2 and O2 can produce H2O that can be captured in a pure state within condenser 56, thereby allowing reuse in electrolyzer 20. In examples, steam system 18, including various Rankine steam turbine and cooling components can be from an existing steam system, while boiler 16 can comprise an upgrade of an existing system, such as by including burners 200 and/or 250 of FIGS. 4 and 5.

VARIOUS NOTES & EXAMPLES

Example 1 is a power plant comprising: a hydrogen fuel supply; an oxygen fuel supply; a water supply; a boiler comprising: a burner for combusting hydrogen from the hydrogen fuel supply and oxygen from the oxygen fuel supply to produce heat, combustion products and low/intermediate-pressure steam; and a first heat exchanger configured to heat water from the water supply to generate high-pressure steam; and a steam turbine comprising: a first turbine configured to be driven only with the high-pressure steam to provide input to a first electrical generator; and a second turbine configured to be driven by low/intermediate-pressure steam from the boiler.

In Example 2, the subject matter of Example 1 optionally includes the boiler further comprising a second heat exchanger configured to receive intermediate-pressure steam from the first turbine and re-heat the intermediate-pressure steam with the heat of the burner and provide re-heated intermediate pressure steam to the second turbine.

In Example 3, the subject matter of Example 2 optionally includes a boiler outlet that is connected directly to an inlet for the second turbine.

In Example 4, the subject matter of any one or more of Examples 2-3 optionally include a boiler outlet that is connected to an outlet of the second heat exchanger.

In Example 5, the subject matter of any one or more of Examples 2-4 optionally include a steam line connecting output of the steam turbine with the boiler.

In Example 6, the subject matter of any one or more of Examples 1-5 optionally includes the water supply comprising a condenser configured to receive steam from the second turbine and to provide water to the boiler.

In Example 7, the subject matter of Example 6 optionally includes the condenser including a deaerator for releasing non-condensable matter in the condensing steam, including the combustion products.

In Example 8, the subject matter of any one or more of Examples 6-7 optionally include an electrolyzer for generating the hydrogen fuel supply and the oxygen fuel supply; a hydrogen storage device for receiving hydrogen from the electrolyzer; and an oxygen storage device for receiving oxygen from the electrolyzer.

In Example 9, the subject matter of Example 8 optionally includes a water storage device between the condenser and the electrolyzer.

In Example 10, the subject matter of any one or more of Examples 8-9 optionally includes a hydrogen expansion device configured to receive pressurized hydrogen from a hydrogen storage device; a second electrical generator configured to be driven by the hydrogen expansion device; an oxygen expansion device configured to receive pressurized oxygen from an oxygen storage device; and a third electrical generator configured to be driven by the oxygen expansion device.

Example 11 is a method of operating a steam plant, the method comprising: combusting hydrogen fuel in a boiler to produce combustion products and low/intermediate-pressure steam; turning a low/intermediate-pressure turbine with the combustion products; condensing water from the combustion products in a condenser; heating water from the condenser in a first heat exchanger within the boiler to produce high-pressure steam; and turning a high-pressure turbine with the high-pressure steam from the first heat exchanger.

In Example 12, the subject matter of Example 11 optionally includes heating a first portion of steam from the high-pressure turbine in a second heat exchanger within the boiler to produce low/intermediate-pressure steam; turning the low/intermediate-pressure turbine with the low/intermediate-pressure steam; and providing a second portion of steam from the high-pressure turbine to the boiler.

In Example 13, the subject matter of Example 12 optionally includes the second portion of steam from the high-pressure turbine being provided to the boiler for combustion.

In Example 14, the subject matter of any one or more of Examples 12-13 optionally include passing the low/intermediate-pressure steam from the boiler directly into the second heat exchanger.

In Example 15, the subject matter of any one or more of Examples 12-14 optionally include passing the low/intermediate-pressure steam from the boiler into output of the second heat exchanger.

In Example 16, the subject matter of any one or more of Examples 12-15 optionally include the second portion of steam from the high-pressure turbine being provided to the boiler for cooling.

In Example 17, the subject matter of any one or more of Examples 11-16 optionally includes burners in the boiler to produce steam that circulates through the boiler in a closed-loop system.

In Example 18, the subject matter of Example 17 optionally includes cooling the burners with a closed-loop of steam from the combustion of the H2 and O2.

In Example 19, the subject matter of Example 17 optionally includes cooling the burners with an open-loop of steam from the combustion of the H2 and O2.

In Example 20, the subject matter of any one or more of Examples 11-19 optionally include condensing water from the combustion products in the condenser and deaerating non-condensable matter from the steam plant.

In Example 21, the subject matter of any one or more of Examples 11-20 optionally include condensing water from the combustion products in the condenser and extracting heat from condensed water in the condenser.

In Example 22, the subject matter of any one or more of Examples 11-21 optionally includes electrolyzing water from the condenser to produce hydrogen and oxygen for combustion.

In Example 23, the subject matter of Example 22 optionally includes storing under pressure hydrogen and oxygen produced by the electrolyzing; and expanding the hydrogen and oxygen for the boiler to produce electricity with electrical generators.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A power plant comprising:
- a hydrogen fuel supply;
- an oxygen fuel supply;
- a water supply;
- a boiler comprising:
  - a burner for combusting hydrogen from the hydrogen fuel supply and oxygen from the oxygen fuel supply to produce heat and combustion products with a combustion process;
  - a first heat exchanger configured to heat water from the water supply to generate high-pressure steam; and
  - a second heat exchanger; and
- a steam turbine comprising:
  - a first turbine configured to be driven only with the high-pressure steam from the first heat exchanger to provide input to a first electrical generator and to deliver a first stream of expanded high-pressure steam to the boiler for generating low pressure steam in the combustion process and a second stream of expanded high-pressure steam to the second heat exchanger; and
  - a second turbine configured to be driven by intermediate-pressure steam from the second heat exchanger and low-pressure steam from the boiler, wherein the intermediate-pressure steam and the low-pressure steam are introduced into an inlet of the second turbine.

2. The power plant of claim 1, wherein a boiler outlet is connected directly to the inlet for the second turbine.

3. The power plant of claim 1 further comprising a steam line connecting output of the steam turbine with the boiler.

4. The power plant of claim 1, wherein the water supply comprises a condenser configured to receive steam from the second turbine and to provide water to the boiler.

5. The power plant of claim 4, wherein the condenser includes a deaerator for releasing non-condensable matter in condensing steam, including the combustion products.

6. The power plant of claim 4, further comprising:

an electrolyzer for generating the hydrogen fuel supply and the oxygen fuel supply;

a hydrogen storage device for receiving hydrogen from the electrolyzer; and an oxygen storage device for receiving oxygen from the electrolyzer.

7. The power plant of claim 6, further comprising a water storage device between the condenser and the electrolyzer.

8. The power plant of claim 6, further comprising:

a hydrogen expansion device configured to receive pressurized hydrogen from a hydrogen storage device;

a second electrical generator configured to be driven by the hydrogen expansion device;

an oxygen expansion device configured to receive pressurized oxygen from an oxygen storage device; and a third electrical generator configured to be driven by the oxygen expansion device.

9. A method of operating a steam plant, the method comprising:

combusting hydrogen fuel in a boiler to produce combustion products in a combustion process;

introducing diluent steam into the boiler to act as a diluent for the combustion process;

introducing the combustion products and the diluent into an inlet of a low/intermediate-pressure turbine;

turning the low/intermediate-pressure turbine with the combustion products and the diluent;

condensing water from the low/intermediate-pressure turbine in a condenser;

heating water from the condenser in a first heat exchanger within the boiler to produce high-pressure steam; and turning a high-pressure turbine with the high-pressure steam from the first heat exchanger;

heating a first portion of steam from the high-pressure turbine in a second heat exchanger within the boiler to produce intermediate-pressure steam;

introducing the intermediate-pressure steam into the inlet of the low/intermediate-pressure turbine;

turning the low/intermediate-pressure turbine with the intermediate-pressure steam; and providing a second portion of steam from the high-pressure turbine to the boiler to be the diluent steam.

10. The method of claim 9, wherein the second portion of steam from the high-pressure turbine is provided to the boiler for combustion.

11. The method of claim 9, further comprising passing the diluent steam from the boiler into output of the second heat exchanger.

12. The method of claim 9, wherein the second portion of steam from the high-pressure turbine is provided to the boiler for cooling.

13. The method of claim 9, wherein combusting hydrogen fuel in the boiler to produce combustion products comprises combusting H2 and O2 with burners in the boiler to produce steam that circulates through the boiler in a closed-loop system.

14. The method of claim 13, further comprising cooling the burners with a closed-loop of steam from the combustion of the H2 and O2.

15. The method of claim 13, further comprising cooling the burners with an open-loop of steam from the combustion of the H2 and O2.

16. The method of claim 9, wherein condensing water from the combustion products in the condenser comprises deaerating non-condensable matter from the steam plant.

17. The method of claim 9, wherein condensing water from the combustion products in the condenser comprises extracting heat from condensed water in the condenser.

18. The method of claim 9, further comprising electrolyzing water from the condenser to produce hydrogen and oxygen for combustion.

19. The method of claim 18, further comprising:

storing under pressure hydrogen and oxygen produced by electrolyzing of water; and expanding the hydrogen and oxygen for the boiler to produce electricity with electrical generators.

20. A power plant comprising:

a hydrogen fuel supply;

an oxygen fuel supply;

a water supply;

a boiler comprising:

a burner for combusting hydrogen from the hydrogen fuel supply and oxygen from the oxygen fuel supply to produce heat and combustion products with a combustion process;

a first heat exchanger configured to heat water from the water supply to generate high-pressure steam; and a second heat exchanger; and a steam turbine comprising:

a first turbine configured to be driven only with the high-pressure steam from the first heat exchanger to provide input to a first electrical generator and to deliver a first stream of expanded high-pressure steam to the boiler for generating low pressure steam in the combustion process and a second stream of expanded high-pressure steam to the second heat exchanger; and a second turbine configured to be driven by intermediate-pressure steam from the second heat exchanger and low-pressure steam from the boiler wherein the intermediate-pressure steam and the low-pressure steam are merged into a single flow before driving the second turbine.

* * * * *